United States Patent [19]

Hammer

[11] 4,101,165

[45] Jul. 18, 1978

[54] HAMMOCK CHAIR

[75] Inventor: Henry H. Hammer, Louisa, Va.

[73] Assignee: Twin Oaks Community, Louisa, Va.

[21] Appl. No.: 773,736

[22] Filed: Mar. 2, 1977

[51] Int. Cl.[2] ..... A47C 15/00

[52] U.S. Cl. ..... 297/273; 297/457; 5/120

[58] Field of Search ..... 297/273–282, 297/457; 5/120–124

[56] References Cited

U.S. PATENT DOCUMENTS

| | | | |
|---|---|---|---|
| 279,432 | 6/1883 | Raymond | 297/274 |
| 2,204,722 | 6/1940 | Boules | 297/457 X |
| 3,165,356 | 1/1965 | Geier et al. | 297/457 X |
| 3,399,926 | 9/1968 | Heha | 297/457 |
| 4,002,368 | 1/1977 | Ortize | 297/273 |

FOREIGN PATENT DOCUMENTS

| | | | |
|---|---|---|---|
| 1,414,579 | 9/1965 | France | 297/457 |
| 175,742 | 2/1922 | United Kingdom | 297/457 |

*Primary Examiner*—Francis K. Zugel

*Attorney, Agent, or Firm*—Griffin, Branigan & Butler

[57] ABSTRACT

A hammock chair includes a rigid, wooden seat frame and a net-like seat fabric extending between rigid frame members. The rigid frame has a quadrangle shape but has one open side. The net-like seat fabric thus forms a chair seat enclosed by rigid members along three edges, but not along a fourth edge. The rigid frame comprises side rigid members attached to the end of a rear rigid member by means of a tension rod which extends lengthwise along the rear rigid member and laterally through the side rigid members. The tension rod is closer to the back edge of the rear rigid member than it is to the front. In one embodiment the net-like seat fabric is attached to the side frame members by means of maple dowels extending through loops in the net-like fabric. In another embodiment the loops interlock with one another. The net-like fabric has a variable density weave. In the preferred embodiment, the frame is supported above the ground by means of an overhead tether support.

18 Claims, 7 Drawing Figures

FIG. 1
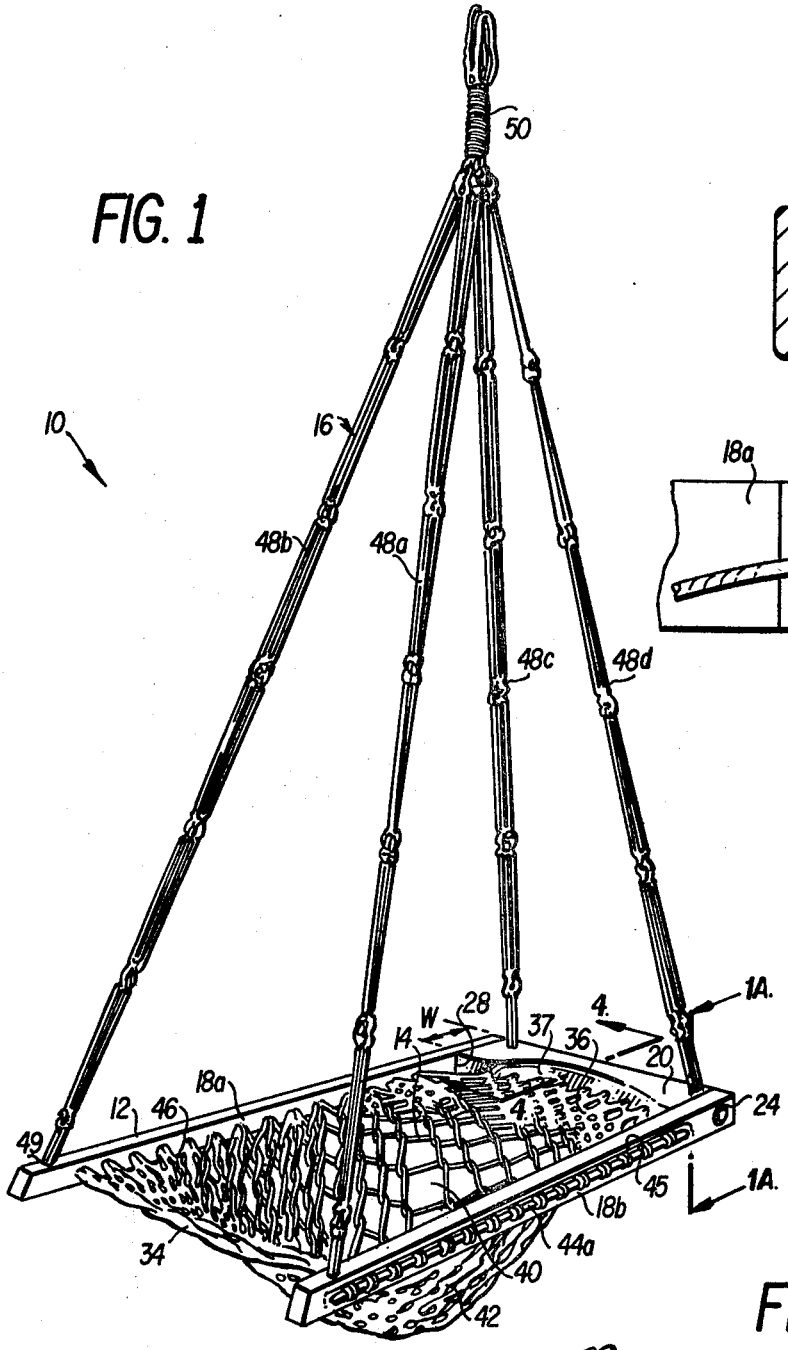
FIG. 1A
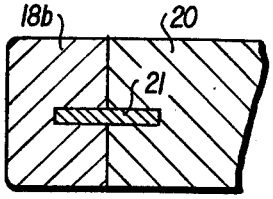
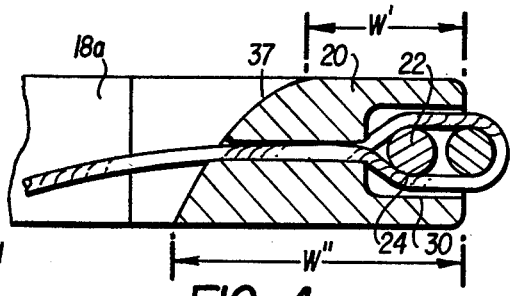
FIG. 4
FIG. 2
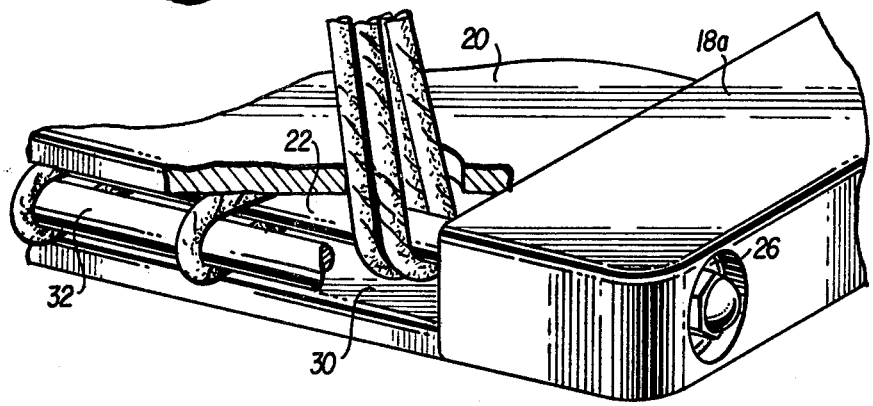

HAMMOCK CHAIR

BACKGROUND OF THE INVENTION

This invention relates broadly to the art of chairs and more specifically to hammock-like chairs.

There are several prior United States patents for so-called "hammock chairs" or chairs having hammock-like seats. These prior-art patents include U.S. Pat. Nos. 580,076 to Wohler and 688,368 to Waddel. In the hammock chairs of these patents, there are closed, substantially rectangular frames having seat fabrics extending across the frames. Occupants of these chairs must have their legs over some portions of the rigid frames since the frames are closed. This contact between the occupants' legs and the rigid frames is not only a source of discomfort but it detracts to some extent from the feeling of being in a hammock. Thus, it is an object of this invention to provide a hammock chair in which an occupant seated therein is not in contact with a rigid frame.

U.S. Pat. Nos. 540,190 to Rawson et al. and 392,112 to Farwell disclose fabric seats for chairs which do not include rigid supports at the fronts thereof (they are open at the front); however, in these chairs ground supports independently provide lateral support for holding side frame members apart. Similarly, U.S. Pat. Nos. 946,225 to Irwin and 148,586 to Wethered disclose fabric seats that are open at the front; however, these seats include rigid substructures below the seats to hold side frame members apart. Thus, it is a further object of this invention to provide a hammock chair including an uncomplicated rigid seat frame which does not require an external support for separating side frame members. In particular, it is an object of this invention to provide such a frame which is not supportively associated with legs of a chair.

It is a further object of this invention to provide a hammock chair which is sturdy, has a pleasing appearance, yet is uncomplicated and relatively inexpensive to manufacture.

SUMMARY

According to principles of this invention, a hammock chair includes a seat fabric extended across a seat frame which is open at the front. In this respect, the seat frame has a quadrangle with one open side. The rigid seat frame includes two side frame members attached to opposite ends of a rear frame member by means of an elongated tension rod which extends longitudinally along the back edge of the rear frame member between the two side frame members. In a preferred embodiment, the frame is supported above the ground by an over-head tether support. The frame is constructed of wood and the tension rod is constructed of a metal such as brass-plated steel. The seat fabric is of a netting fabric which has a variable density weave to provide more or less support at particular areas of the seat. In one embodiment the netting is attached to the side frame members by inserting loops through holes in the frame members and then inserting dowels through the loops on the outsides of the frame members. In another embodiment the loops are interlocked on the outsides of the frame members.

BRIEF DESCRIPTION OF THE DRAWINGS

The foregoing and other objects, features, and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is an isometric view of a hammock chair employing principles of this invention;

FIG. 1*a* is a sectional view taken on line 1*a*—1*a* in FIG. 1;

FIGS. 2 and 3 are segmented isometric views showing details of the hammock chair of FIG. 1;

FIG. 4 is a sectional view taken on line 4—4 in FIG. 1;

DESCRIPTION OF A PREFERRED EMBODIMENT

Figure 3:
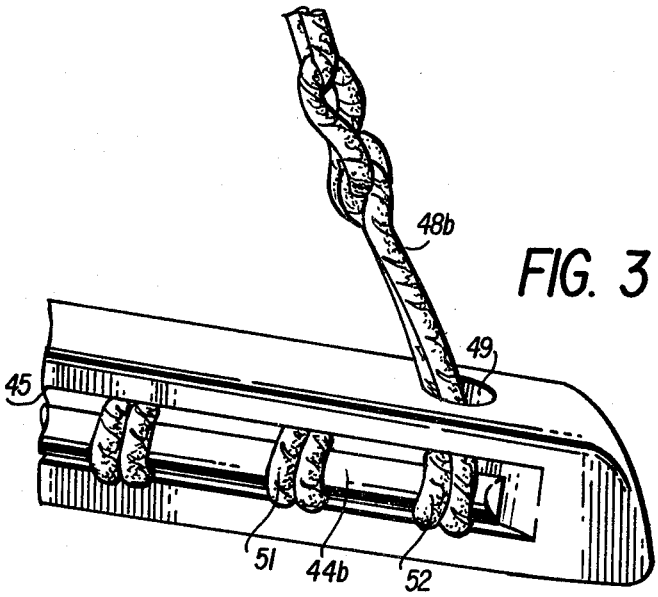

A hammock chair 10 includes basically a seat frame 12, a seat fabric 14, and a main support 16. In the illustrated embodiment, the main support 16 is an overhead, or hang-type tether which is attached to a ceiling, beam, or the like. In this respect, however, it would also be possible to use the seat frame 12 and the seat fabric 14 with a leg-type main support.

The seat frame 12 comprises, basically, two side frame members 18*a, b* and a rear frame member 20. The side and rear frame members 18*a, b* and 20 are of a hard, kiln-dried, clear oak wood, preferably white oak. The side frame members 18*a, b* are mounted at opposite ends of the rear frame member 20 and extend outwardly therefrom in a slightly diverging manner. In this respect, the side and rear frame members of the seat frame 12 are arranged in the shape of a four-sided figure or quadrangle, however, there is no frame member at one side, the front, of the quadrangle. In other words, the seat frame 12 forms a quadrangle with one open side.

Discussing particularly the manner in which the side frame members 18*a, b* are mounted at the ends of the rear frame member 20, at opposite ends of the rear frame member 20 are dowels or pins 21 (FIG. 1*a*) which extend into holes in the side frame members 18*a, b* and the ends of the rear frame member. However, in addition, and significantly, a brass-plated steel tension rod 22 extends longitudinally along the back edge of the rear frame member 20 through transverse holes 24 in the back ends of the side frame members 18*a, b*. At both ends of the tension rod 22 are washers 26 of approximately one square inch surface area held in contact with the outside surfaces of the side frame members 18*a, b* by cap nuts at opposite ends of the rod 22. The side frame members 18*a, b* are basically held in position by tension forces acting on the tension rod 22 and compression forces produced at front corners 28 of the rear frame member 20. Of course, the interlocking of the pins 21 holds the side and rear frame members 18*a, b* and 20 in proper attitudes relative to one another but the main loads are carried by the tension rods 22 in tension and the front corners 28 of the rear frame member 20.

The rear edge of the rear frame member 20 has a groove 30 therein in which the tension rod 22 extends.

The groove 30 also encases a rear net retaining dowel 32 as is disclosed in more detail below.

The seat fabric 14 in the illustrated embodiment, is a net-like material formed of woven ropes. The weave of the seat fabric 14 has a variable density, with the higher density weave being at a front portion 34 and the rear portion 36 of the seat fabric 14. The front portion 34 is located at the opening in the seat frame 12 and the higher density weave is intended to support an occupant's legs which dangle over the front portion 34. The higher density weave in the rear portion 36 provides increased support to hold an occupant away from the front edge 37 of the rear frame member 20. In this respect, the front edge 37 of the rear frame member 20 is beveled in the middle as shown in FIG. 4 so as to form an edge surface paralleling the angle of a back edge 40 of a seat cup 42. Thus, if an occupant's back should come in contact with the front edge 37 of the rear frame member 20, the forward edge 38 is shaped to fit the back. However, in normal cases, the occupant's back is held away from the front edge 37 of the rear frame member 20 by the higher density weave of the seat fabric rear portion 36.

In the preferred embodiment the washers 26 are countersunk into the members 18*a, b*. Also, in the preferred embodiment, the rear frame member 20 has end widths *w* (FIG. 1) of 3½ inches, a top middle width *w'* (FIG. 4) of 2 inches and a bottom middle width *w''* of 3 inches. The rear frame member 20 is approximately 19¾ inches long. All of the rigid frame members are 1⅝ inches thick. The side frame members 18*a, b* have substantially square cross sections and are approximately 30 inches long.

The seat fabric 14 is attached to the side and rear frame members 18*a, b* and 20 by means of side net retaining dowels 44*a, b* and the rear net retaining dowel 32. In this respect, loops 51 at the edge of the seat fabric 14 are inserted through transverse holes 46 in the side and rear frame members 18*a, b* and 20 and the side and rear net retaining dowels are respectively inserted through the loops 51 on the outsides of the frame members. Thus, the loops cannot pass back through the holes in the frame members. In the case of the rear net retaining dowel 32, it is seated in the groove 30 as was previously explained. Likewise, the side net retaining dowels 44*a, b* are seated in grooves 45 in the side frame members 18*a, b*.

The tether-like overhead main support 16 includes front support lines 48*a, b* and rear support lines 48*c, d*. The front support lines 48*a, b* pass down through vertical holes 49 at the forward ends of the side frame members 18*a, b*, and sideways through horizontal holes (not shown) to form loops 52 about the side net retaining dowels 44*a, b*. The rear support lines 48*c, d* pass through vertical holes in opposite ends of the rear frame member 20 and encircle the tension rod 22 as shown in FIG. 2.

Figure 5:
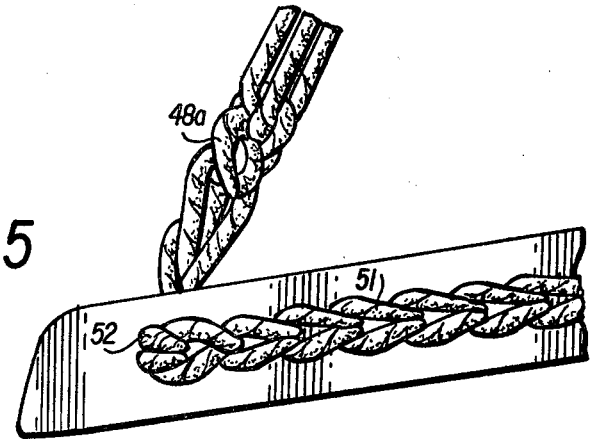
FIG. 5 is a segmented side view of a modified embodiment of a hammock chair employing principles of this invention.
Figure 6:
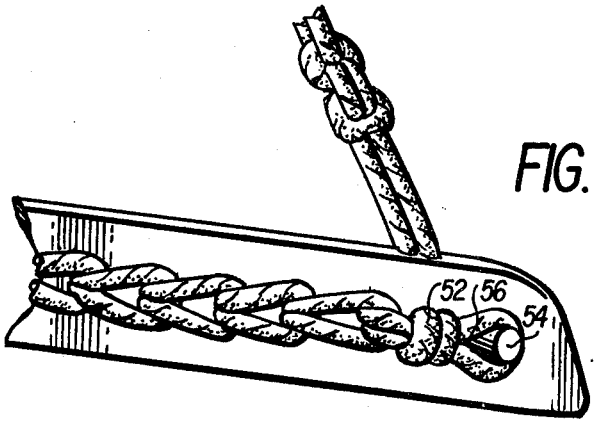
FIG. 6 is a segmented isometric view of a second modified embodiment of a hammock chair employing principles of this invention.

In modified embodiments depicted in FIGS. 5 and 6 the seat-fabric loops 51 are interlocked with each other so that the side net retaining dowels 44*a, b* are not needed. In these modifications the front support line loops 52 are interlocked with the seat fabric loops 51. In the FIG. 6 version a separate peg 54 is used to anchor forward most seat-fabric loops 56 and the front support line loops 52 loop laterally over these seat-fabric loops 56.

In a preferred embodiment, the support lines 48*a–d* are approximately 50–60 inches long with the front support lines 48*a, b* being approximately 8 inches longer than the rear support lines 48*c, d*. The support lines 48*a–d* merge to a common support line 50 which is supported from above by a beam, ceiling or the like. When there is no occupant in the hammock chair 10 it hangs at a rear-to-front downward angle of between 10° and 15° with the horizontal. This angle changes somewhat once an occupant sits in the hammock chair 10; however, the change in the angle depends to some extent on the weight of the occupant.

In operation, the common support line 50 is hung from an overhead support and an occupant sits on the seat fabric 14 with his legs dangling over the front portion 34. The high density weave of the front portion 34 flexes in the manner of a hammock to provide comfort but yet to also provide sufficient support to maintain the shape of the seat cup 42 and thereby hold the occupant in the seat fabric 14. There is no rigid frame front member to bother an occupant. When an occupant sits in the seat fabric 14, the forward ends of the side frame members 18*a, b* tend to flex toward one another, however, they are held securely by the tension rod 22. The flexing of the side frame members 18*a, b* adds to the comfort of an occupant by providing increased "bounce" to the seat fabric 14.

It will be appreciated that the hammock chair of this invention is extremely comfortable, durable, and "charming" in appearance. In particular, the tension rod 22 combines with the hard oak rear and side frame members 20 and 18*a, b* to provide a unique and uncomplicated supporting structure.

While the invention has been particularly shown and described with reference to a preferred embodiment, it will be understood by those skilled in the art that various changes in form and detail may be made therein without departing from the spirit and scope of the invention. For example, it would be possible to attach the side frame members 18*a, b* to the rear frame member 20 by normal tongue and groove and vertical bolt connections without having the tension rod 22 extending laterally between the side frame members 18*a, b;* however, such a frame has not been found to be durable in both indoor and outdoor weather. Further, seat fabric 14 other than the netting described in this application could be used. In one embodiment, sheep skin is used.

The embodiments of the invention in which an exclusive property or privilege are claimed as defined as follows:

1. In a hammock chair for supporting an occupant above a floor, said hammock chair including a rigid outer seat frame for supporting a seat fabric, a flexible seat fabric extending across the frame for holding said occupant, and a main support means for supporting said frame above said floor, the improvement wherein said rigid outer frame includes two independent side rigid members and an independent rear rigid member, said rear rigid member having mounted thereon an attaching means for mounting said side rigid members at opposite ends of said rear rigid member to form the shape of a quadrangle having one open side, said seat fabric extending between said rear and side rigid members to form a chair seat enclosed by said rear and side rigid members along three edges thereof but not along a fourth forward edge thereof, said side rigid members extending lengthwise along the ends of said rear rigid member and said attaching means including an elongated tension rod extending transversely through both of said side rigid members and longitudinally along said rear rigid member proximate a rear edge of said rear rigid member, such that when an occupant sits in the flexible seat fabric said side rigid members are held in position by tension forces acting on the tension rod and compression forces produced at forwardly positioned corners of the rear rigid member, said forward ends of the side rigid members tending to flex toward one another.

2. In a hammock chair as in claim 1 wherein said main support means is a tether for supporting said frame from an overhead support.

3. In a hammock chair as in claim 2 wherein said side and rear rigid members are of wood.

4. In a hammock chair as in claim 3 wherein said elongated tension rod extends longitudinally through said rear rigid member at a rear edge of said rear rigid member.

5. In a hammock chair as in claim 4 wherein said flexible seat fabric is netting having a variable density weave, with the weave of the netting at the open side of the frame and near the rear rigid member being denser than the weave at other portions of the netting.

6. A hammock chair as in claim 5 wherein said netting is attached to said rear and side rigid members by inserting loops of said netting through holes in said side and rear rigid members and wherein is further included dowel means which are passed through said loops on the outsides of said side and rear rigid members.

7. A hammock chair as in claim 6 wherein said tether includes loops which are inserted through holes in said side rigid members and which are looped about said dowel means to prevent them from pulling out of said holes.

8. A hammock chair as in claim 5 wherein said netting is attached to said side rigid members by inserting loops of said netting through holes in said side rigid members and interlocking said loops on the outsides of said side rigid members.

9. A hammock chair as in claim 8 wherein said tether includes loops which are inserted through holes in said side rigid members and which are interlocked with the loops of said netting on the outsides of said side rigid members.

10. In a hammock chair as in claim 1 wherein said side and rear rigid members are of wood.

11. In a hammock chair as in claim 1 wherein said elongated tension rod extends longitudinally through said rear rigid member at the rear edge of said rear rigid member.

12. In a hammock chair as in claim 11 wherein said flexible seat fabric is a netting having a variable density weave, with the weave of the netting at the open side of the frame and near the rear rigid member being denser than the netting weave at other portions of the seat fabric.

13. In a hammock chair as in claim 12 wherein said netting is attached to said rear and side rigid members by inserting loops of said netting through holes in said side and rear rigid members and wherein is further included means interlocked with said loops on the outsides of said side and rear rigid members to prevent said loops from pulling out of said holes.

14. In a hammock chair as in claim 1 wherein said flexible seat fabric is a netting having a variable density weave, with the weave of the netting at the open side of the frame and near the rear rigid member being denser than the netting weave at other portions of the seat fabric.

15. In a hammock chair as in claim 14 wherein said netting is attached to said rear and side rigid members by inserting loops of said netting through holes in said side and rear rigid members and wherein is further included means interlocked with said loops on the outsides of said side and rear rigid members to prevent said loops from pulling out of said holes.

16. In hammock chair for supporting an occupant above a floor, said hammock chair including a rigid outer seat frame for supporting a seat fabric, a flexible seat fabric extending across the frame for holding said occupant, and a main support means for supporting said frame above said floor, the improvement wherein the rigid outer frame includes two side rigid members and a rear rigid member, said rear rigid member including an attaching means for mounting said side rigid members at opposite ends of said rear rigid member to form the shape of a quadrangle having one open side, said seat fabric extending between said rear and side rigid members to form a chair seat inclosed by said rear and side rigid members along three edges therof but not along a fourth forward edge thereof, said flexible seat fabric being a netting having a variable density weave, with the weave of the netting at the open side of the frame and near the rear rigid member being denser than the weave at other portions of the netting.

17. A hammock chair as in claim 16 wherein said netting is attached to said rear and side rigid members by inserting loops of said netting through holes in said side and rear rigid members and wherein is further included dowel means which are passed through said loops on the outsides of said side and rear rigid members.

18. A hammock chair as in claim 17 wherein said main support means is a tether for supporting said frame from an overhead support and wherein the said tether includes loops which are inserted through holes in said rigid members and which are interlocked with the loops of said netting on the outside of said side rigid members.

* * * * *